US012680797B2

(12) United States Patent
Zavitsanos et al.

(10) Patent No.: US 12,680,797 B2
(45) Date of Patent: Jul. 14, 2026

(54) PROJECTILES, REACTIVE COMPOSITIONS FOR PROJECTILES AND ARTICLES CONTAINING THE REACTIVE COMPOSITION

(71) Applicant: General Sciences, Inc., Souderton, PA (US)

(72) Inventors: Peter D. Zavitsanos, Gwynedd Valley, PA (US); Dmitri A. Bohn, Green Lane, PA (US)

(73) Assignee: General Sciences, Inc., Souderton, PA (US)

( * ) Notice: Subject to any disclaimer, the term of this patent is extended or adjusted under 35 U.S.C. 154(b) by 0 days.

(21) Appl. No.: 18/626,031

(22) Filed: Apr. 3, 2024

(65) Prior Publication Data

US 2025/0216183 A1 Jul. 3, 2025

Related U.S. Application Data

(60) Provisional application No. 63/456,676, filed on Apr. 3, 2023.

(51) Int. Cl.

| | |
|---|---|
| ***F42B 12/44*** | (2006.01) |
| ***C06B 45/00*** | (2006.01) |
| ***F42B 5/145*** | (2006.01) |
| ***F42B 12/06*** | (2006.01) |
| ***F42B 12/08*** | (2006.01) |

(Continued)

(52) U.S. Cl.

CPC ..... *F42B 12/44* (2013.01); *C06B 45/00* (2013.01); *F42B 5/145* (2013.01); *F42B 12/06* (2013.01); *F42B 12/08* (2013.01); *F42B 12/74* (2013.01); *F42B 12/04* (2013.01)

(58) Field of Classification Search

CPC ..... F42B 5/145; F42B 12/04; F42B 12/06; F42B 12/08; F42B 12/44; F42B 12/74; F42B 12/46; C06B 45/00

USPC ..... 102/364

See application file for complete search history.

(56) References Cited

U.S. PATENT DOCUMENTS 6,691,622 B2 * 2/2004 Zavitsanos ..... C06B 33/00 102/478

7,603,951 B2 * 10/2009 Rose ..... F42B 12/44 102/500

(Continued)

*Primary Examiner* — James S Bergin

(74) *Attorney, Agent, or Firm* — Buchanan Ingersoll & Rooney PC

(57) ABSTRACT

A projectile including a reactive composition is disclosed. The reactive composition includes at least one fuel comprising a titanium-boron composite, at least one oxidizer, and at least one metal hydride. When the projectile penetrates through a surface of a target having a volume of 0.2 $m^3$, the reactive composition is configured to cause, behind the surface of the target, at least one of an overpressure of greater than 36 pounds per square inch (psi) or an incendiary effect duration of greater than 70 milliseconds. The reactive composition may be configured to partially or entirely surround a pin or penetrator. The projectile may lack a pin or penetrator, and the reactive composition is contained within a metal tube or cup configured to travel toward, within, and/or behind a surface of the target, wherein the process produces a punch out from the target, thereby acting as a second projectile, which enhances lethality.

13 Claims, 19 Drawing Sheets

(51) Int. Cl.
*F42B 12/74* (2006.01)
*F42B 12/04* (2006.01)

(56) References Cited

U.S. PATENT DOCUMENTS

| | | | | |
|---|---|---|---|---|
| 8,122,833 | B2 * | 2/2012 | Nielson | F42B 12/36 102/516 |
| 8,568,541 | B2 * | 10/2013 | Nielson | F42B 12/207 149/37 |
| 8,826,823 | B2 * | 9/2014 | Thuman | F42B 12/36 102/517 |
| 8,857,342 | B2 * | 10/2014 | Wilson | F42B 12/06 102/517 |
| 9,702,678 | B1 * | 7/2017 | Moretti | F42B 12/44 |
| 2009/0308272 | A1 * | 12/2009 | Schroeder | F42B 12/06 102/364 |

* cited by examiner

AIS-IT Damage from .50 CAL. with Projectile #1

AIS-IT Damage from Conventional Projectile

| Projectile | Cavity Volume ($cm^3$) | Cavity Depth (cm) | Depth of Penetrator (cm) |
|---|---|---|---|
| Conventional Projectile | 12.32 | 1.5 | 4.4 |
| Prototype Projectile #1 | 13.8 | 2.55 | 3.65 |
| Prototype Projectile #2 | 14.2 | 2.75 | 3.8 |

Back of 0.375" Steel Plate with Punch-Out

Front of 0.375" Steel Plate with Punch-Out

Steel Fragment Penetration Site 1st Witness Plate

Reaction Pattern Front of 1st Al-Witness Plate

Reactive Cup Penetration Hole 1st Witness Plate

Backside of 1st Witness Plate Showing Steel

1st Al-Witness Plate Exit Hole from Reactive Cup

1st Al Witness Plate Exit Hole from Steel Fragment

A. Monolithic High Density Reactive Penetrator

B. Projectile with Maximum Reactive Content

C. Limited Range High Lethality Reactive Projectile

PROJECTILES, REACTIVE COMPOSITIONS FOR PROJECTILES AND ARTICLES CONTAINING THE REACTIVE COMPOSITION

CROSS-REFERENCE TO RELATED APPLICATIONS

This application claims the benefit of priority to U.S. Provisional Application No. 63/456,676 filed on Apr. 3, 2023, which is incorporated herein by reference in its entirety for all purposes.

FIELD OF THE INVENTION

The present invention relates to the field of projectile design, including the placement and/or location of reactive materials or compositions within the projectile. The present invention further relates to the field of reactive materials or compositions, and particularly to reactive materials or compositions suitable for use in incendiary or explosive compositions, ammunition, munitions, projectiles, weaponry, and the like.

BACKGROUND OF THE INVENTION

Conventional fifty caliber projectiles typically include high explosives, incendiary fills, and a penetrating core of steel, tungsten, or tungsten carbide. Armor-piercing projectiles (e.g. bullets) may have a nose piece made of aluminum, brass, or other metal, as well as penetrators (cones or pins) made of steel, tungsten, and/or tungsten carbide. These armor-piercing penetrators such as M8, M20, and MK211 (Raufoss) may penetrate up to 0.5 inches of hardened steel, but they are less effective in providing behind-armor damage (e.g., damage behind the penetrated surface of the target) due to a reduced ability to transfer pressure and/or thermal load inside of the target. Accordingly, there is a need to improve upon existing reactive compositions and bullet designs, as well as provide alternatives to existing projectiles or like articles which improve lethality (e.g., through behind-armor damage) without undesirably reducing armor piercing/penetration capability.

SUMMARY OF THE INVENTION

According to a first aspect of the present invention, a projectile including a reactive composition is disclosed. The reactive composition includes at least one fuel having a titanium-boron composite; at least one oxidizer; at least one metal hydride; wherein when the projectile penetrates through a surface of a target having a volume of 0.2 $m^3$, the reactive composition is configured to provide, behind the surface of the target, at least one of an overpressure of greater than 36 pounds per square inch (psi) or an incendiary effect duration of greater than 180 milliseconds, or an overpressure of greater than 60 pounds per square inch (psi) or an incendiary effect duration of greater than 70 milliseconds.

According to another aspect of the present invention, a reactive penetrator is disclosed. The reactive penetrator includes a housing having a cavity and a reactive composition disposed in the housing. The reactive composition has at least one fuel comprising a titanium-boron composite; at least one oxidizer comprising bismuth trioxide or potassium nitrate; and at least one metal hydride.

According to another aspect of the present invention, a reactive case for a munition is disclosed. The reactive case includes a housing having a cavity and an inner surface. The reactive case also comprises a liner coating the inner surface of the housing. The liner has a reactive composition, the reactive composition comprising: at least one fuel comprising a titanium-boron composite; at least one oxidizer; and at least one metal hydride.

According to another aspect of the present invention, a projectile or large munition configured to impact a target is disclosed. The projectile includes a housing having a cavity and high explosives disposed in the cavity. The projectile has a metallic foam disposed in the cavity and partially or entirely surrounds the high explosives. The metallic foam is impregnated with a reactive composition. The reactive composition comprises: at least one fuel, at least one oxidizer, and at least one metal hydride.

BRIEF DESCRIPTION OF THE DRAWINGS

The above and other aspects and features of the present invention will become more apparent to those of ordinary skill in the art by describing in detail exemplary embodiments thereof with reference to the following drawings. The following drawings are provided to help explain embodiments described herein, and are not intended to limit the scope of the appended claims.

DETAILED DESCRIPTION OF THE INVENTION

Figure 1:
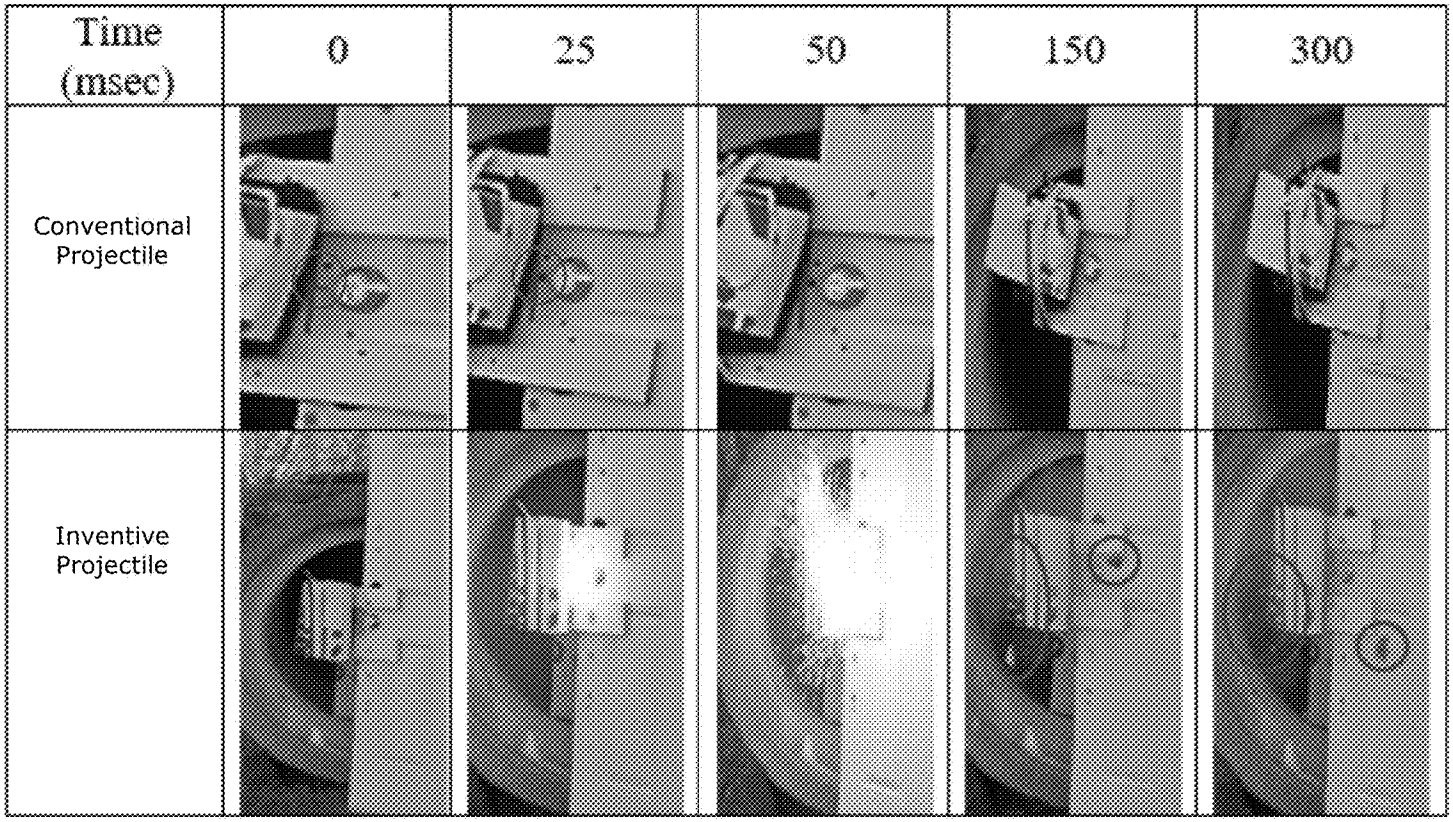
FIGS. 1-2 depict results of an exemplary door defeat test.

Although the invention is illustrated and described herein with reference to specific embodiments, the invention is not intended to be limited to the details shown. Rather, various modifications may be made in the details within the scope and range of equivalents of the claims and without departing from the invention.

Additionally, various forms and embodiments of the invention are illustrated in the figures. It will be appreciated that the combination and arrangement of some or all features of any of the embodiments with other embodiments is specifically contemplated herein. Accordingly, this detailed disclosure expressly includes the specific embodiments illustrated herein, combinations and sub-combinations of features of the illustrated embodiments, and variations of the illustrated embodiments.

As used throughout the specification, the term "target" is intended to encompass both soft target penetration and hard target penetration. Traditional soft target projectiles rely on expansion of the projectile after target impact (e.g. projectiles with a "soft" lead core and a copper jacket, with lead being a relatively soft metal that expands upon impact, so that the size of the projectile increases in size). Expansion of soft target projectiles thereby increases the size of the penetration channel and increases energy transfer or lethal impact to the target. In contrast, traditional hard target penetration requires use of "hard" metals (steel, tungsten, etc.) for the penetrator or pin. Limiting the expansion provides more concentrated impact of energy in a smaller area, thereby increasing penetration. Still further, the term "target" also encompasses structures that comprise steel, aluminum, and titanium. Additionally, non-limiting examples of soft targets include aircraft, helicopters, and military land vehicles, each of which may carry personnel or cargo. Likewise, non-limiting examples of relatively harder or hard targets include mortars and other structures comprising steel armor personnel carriers with a thickness between 0.25 and 0.5 inches. Further, the term target includes structures having 0.2 cubic meters ($m^3$), or a predetermined volume inclusive of control electronics, for example.

Similarly, the term "lethality" is intended to encompass any and all impacts that can cause death or serious harm or damage to various targets such as, for example, helicopters, aircraft, and armored vehicles.

Likewise, the term "projectile" or "article" is intended to encompass structures for use in incendiary or explosive compositions, ammunition, munitions, projectiles, weaponry, armor-piercing projectiles, and the like. Although the projectile, as used in the description below, may refer to a "bullet" or "round," one skilled in the art would understand from the description herein that the inventive reactive composition and use thereof is not so limited. Instead, the reactive composition may be used or contained in other munitions, or reactive cases for such munitions.

A reactive composition is disclosed. In general, the reactive composition, such as reactive composition 160 (FIG. 11), includes reactive materials, including but not limited to intermetallics, metal hydrides, thermites, thermates, and metal/oxidizer composites. In an exemplary embodiment, the disclosed reactive materials may form solid products of predetermined size and geometry. Additionally or optionally, the reactive composition include binders, which react with one or more of the reactive materials, and/or act as gas generators, thereby improving or enhancing one or more of pressure and temperature to increase lethality (further discussed below).

Additionally or optionally, the reactive composition includes other reactive materials, including composites which produce higher temperatures as well as hard reactive particles which can undergo further combustion within (i.e. inside) or behind the target. In an exemplary embodiment, the exemplary combination of materials of the inventive reactive composition generally causes a release of greater chemical energy upon target impact, as well as subsequent release of equivalent or greater chemical energy from the combustion of reaction products, thereby increasing thermal and overpressure loads behind the penetrated target surface (e.g. having a thickness of 0.5 inches). Thus, the exemplary combination of materials of the inventive reactive composition synergistically raises pressure and/or temperature, thereby causing increased lethality (discussed further below).

In an exemplary embodiment, the reactive composition generally includes at least one fuel; at least one oxidizer; at least one intermetallic composite; and at least one metal hydride. The at least one fuel containing metal may be coated with a thin film of polymeric material to increase processing safety.

In an exemplary embodiment, the at least one fuel includes a titanium-boron composite. Generally, the at least one fuel include fuel compositions, which upon ignition produces very hot (e.g. more than 3,000° C.) hard particulates and combustible hydrogen gas, when in reaction with metal hydrides (e.g. $TiH_2$), for example. These fuel compositions are improved in terms of increasing the efficient output of said fuel when used in combination with titanium and/or boron. This exemplary combination generates enhanced lethality characterized by an increase in pressure generated behind or within the target, due to $TiB_2$ hot ceramic particulates (reaching temperatures of approximately 3200° C.), which upon mixing with air, produce combustion products of $TiO_2$ and $B_2O_3$, thereby releasing additional heat or energy that is generally several (e.g. six) times higher than high explosives (HE), subject to one or more factors (e.g. mixing with air, etc.).

In an exemplary embodiment, the at least one fuel includes fuels containing a metal/boron composition, including but not limited to Ti/2B, which self-reacts to form $TiB_2$ hot particles with a specific energy (or energy per mass) of 1.2 kcal/g (higher than HE) or 5 kcal/$cm^3$ (approximately 3 times higher than HE). Upon mixing with air, $TiB_2$ hot particles generate combustion products of metal and boron oxides (e.g. $B_2O_3$ and $TiO_2$) which have a potential additional energy of 5 kcal/g. This energy increase is several times higher than conventional fuel compositions, which include HE, or conventional metal combustion by common oxidizers (e.g. perchlorates). Replacement of such common oxidizers, such as perchlorates, provides an added benefit because perchlorates are known to undesirably release chlorine in the environment. Other metal/boron compositions (instead of Ti/2B) which achieve similar results may also be suitable. In another exemplary embodiment, the at least one fuel includes aluminum or magnalium (e.g. an Al/Mg alloy).

In an exemplary embodiment, the at least one oxidizer comprises bismuth trioxide. Other oxidizers will become apparent to one of ordinary skill in the art upon review of this disclosure. For example, in other embodiments, the at least one oxidizer may include one or more of bismuth oxide, copper oxide, and/or potassium periodate. As stated above, use of perchlorates may be replaced by potassium nitrate, which is as an environmentally preferable oxidizer as compared to conventional oxidizers containing chlorine. In an exemplary embodiment, the at least one intermetallic composite comprises a metal hydride. Addition of metal hydride compositions is desirable because the combustion of hydrogen can enhance pressure and lethality behind a target surface (e.g. armor plate). As non-limiting examples, the metal hydride includes titanium hydride, magnesium hydride, and aluminum hydride. Other metal hydrides may also be suitable, including lower cost metal hydrides or those which or can safely decompose upon reaction, but also cause combustion and increased pressure within the target, thereby increasing lethality. Unlike conventional reactive compositions, metal hydrides are added to the reactive composition as pressure generators. In an exemplary embodiment, conventional inert cores or penetrators, which typically comprise steel, tungsten, or tungsten carbide, can be replaced by the inventive reactive composition, which includes a high-density reactive intermetallic composite containing tungsten capable of penetrating a target (e.g. steel) for a depth of at least 0.5 inches.

In an exemplary embodiment, the reactive composition includes particles of high-density metals. This addition increases density of the reactive composition for up to a range of, e.g., between 8 g/cm$^3$ and 10 g/cm$^3$, thereby causing deeper penetration. For example, a high density (7-8) g/cm$^3$ intermetallic sintered reactive composition added to an exemplary 9 mm projectile provides for greater penetration and defeating door locks in a single shot. Non-limiting examples of such high-density metals include tungsten, tantalum, and uranium, alone or in intermetallic reaction with lighter metals such as Ti, Al, and the like.

In some embodiments, the reactive composition 106 may optionally include one or more binders and pacifiers, such as a halocarbon grease (PCTFE) or polytetrafluoroethylene (PTFE) suspension.

A non-exhaustive list of exemplary stoichiometric amounts of certain fuels and oxidizers of reactive composition 160, 260 is provided in Table 1 below:

TABLE 1

Exemplary Stoichiometric Amounts of Fuels and Oxidizers

| Fuels | Oxidizers |
|---|---|
| 2 MgAl | 5 CuO |
| 2MgAl | $_{5/3}$ $Bi_2O3$ |
| Ti | 2 CuO |
| Ti—2B | 5/3 $BiO_3$ |
| Ti—$TiH_2$—4B | 13/3 $BiO_3$ |
| Hf | 2 CuO |

A person of ordinary skill in the art will appreciate upon review of the instant disclosure that the relative amounts of these exemplary fuels and oxidizers may be varied beyond what is shown in Table 1 above, including through the use of non-stoichiometric amounts.

For clarity, in the table listed above: $KIO_4$ is potassium periodate; $KClO_4$ is potassium perchlorate; CuO is copper oxide; MgAl is magnalium 50/50; and $Bi_2O_3$ is bismuth trioxide, and $TiH_2$ is titanium hydride, and Hf is hafnium.

The inventive reactive composition provides increased lethality. In one non-limiting example, the increased lethality is characterized by an increase in energy release (e.g. higher or larger energy release) as measured at the site of penetration or impact of target. Additionally or optionally, the increased lethality is characterized by a relatively larger size or volume of penetration relative to the target site (e.g. size of affected area behind armor plate). In an exemplary embodiment, upon impact with the target, the increased lethality is characterized by a reactive composition that is formulated to provide a damage property related to a perforation of at least a portion of the target. In a non-limiting example, the damaged property is related to a penetration of the target. The penetration may extend for a depth within, through, or behind a surface of the target, and the depth is at least 0.5 inches.

Additionally or optionally, the increased lethality is characterized by increase in incendiary effect (as measured by one or more of temperature, exothermicity), pressure, and shrapnel from the broken projectile after penetration of the target. In an exemplary embodiment, the reactive composition is configured to, when penetrating a target having a volume of approximately 0.2 m$^3$, provide a maximum overpressure of greater than 36 pounds per square inch (psi). In a preferred embodiment, the maximum overpressure of greater than 75 pounds psi. One skilled in the art would understand from the description herein that generally, when projectile (e.g., projectile 100, 200) penetrates through a surface of a target having a larger volume (e.g., greater than a volume of 0.2 m$^3$), the overpressure will be lower (e.g., relative to that of a target having volume of 0.2 m$^3$). Conversely, when the projectile (e.g., projectile 100) penetrates through a surface of a target having a smaller volume (e.g., less than a volume of 0.2 m$^3$), the overpressure will be higher (e.g., relative to that of a target having a volume of 0.2 m$^3$).

Additionally or optionally, the reactive composition is configured to provide an incendiary effect duration of greater than 70 milliseconds. In a preferred embodiment, the incendiary effect duration is greater than 150 milliseconds. Additionally or optionally, the incendiary effect occurs at the depth of penetration (e.g. at least 0.5 inches behind a surface of or within the target). In this way, lethality of the reactive composition or the projectile containing the reactive composition is achieved by delivering the impact or damage further within or behind the target (e.g. armor), e.g. transferring pressure and thermal load inside or behind a surface of the target.

In addition to an increased lethality, the inventive reactive composition as well as projectiles or articles containing the same achieve multiple advantages. For example, the inventive reactive composition leads lower hazard classification due to the elimination of high explosives, thereby also leading to lower costs. In addition, the reactive composition does not contain high explosives, unlike conventional designs, such that transportation is not hindered by additional hazard requirements for shipping or transportation.

Turning now to FIGS. 11-15, a projectile containing a reactive composition is disclosed. In an exemplary embodiment, the projectile is a 50-caliber reactive projectile. In another exemplary embodiment, the projectile is a 9 mm round.

Figure 11:
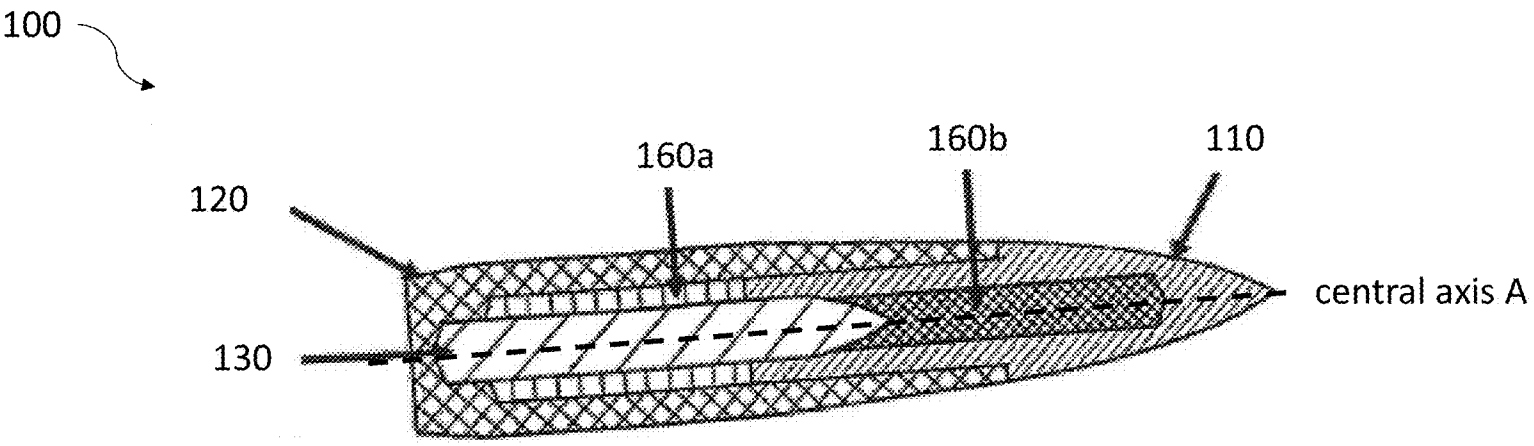
FIG. 11 depicts an exemplary armor-piercing projectile in accordance with an embodiment of the invention, showing exemplary locations of a reactive composition.
Figure 12:
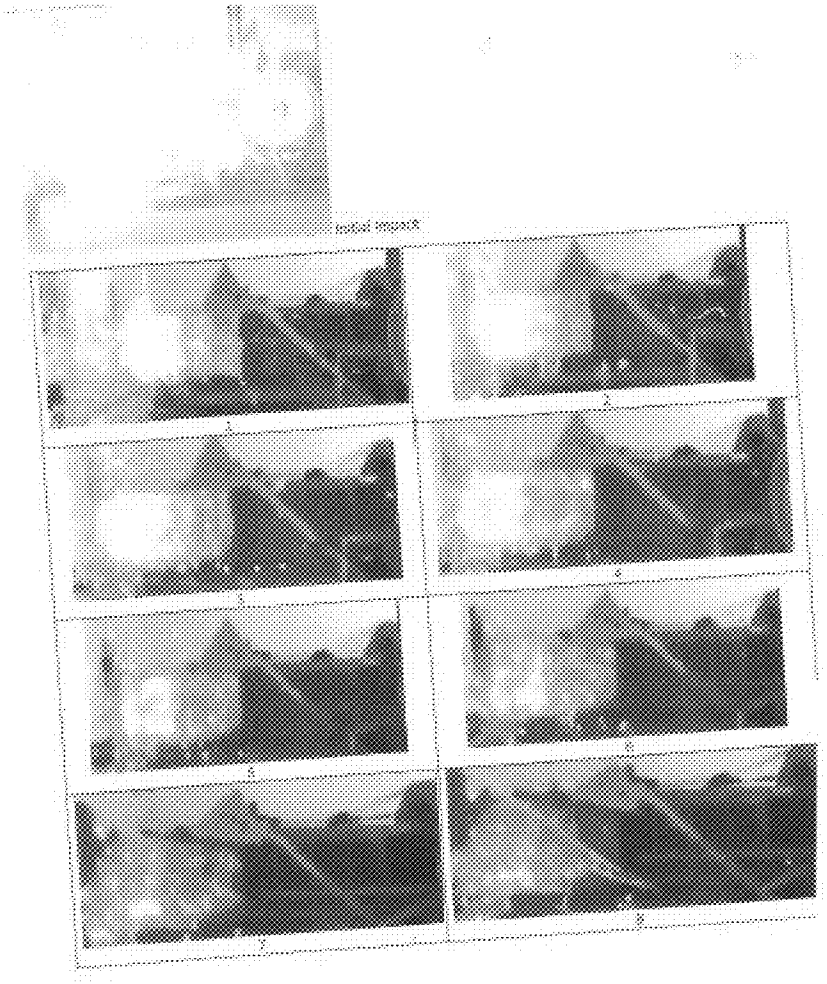
FIG. 12 depicts the armor-piercing projectile of FIG. 11, showing marking capability and flash.

In an exemplary embodiment, the projectile comprises an armor-piercing projectile. As shown in FIG. 11, which illustrates a cross-section of an exemplary projectile 100, a front tip 110 is coupled to a housing, such as an outer jacket 120. Together the front tip 110 and outer jacket 120 form an interior configured to house one or more components of projectile 100. The interior may also define a central axis 'A'. In a non-limiting example, an armor-piercing penetrator or penetrating pin 130 is disposed in the interior and aligned along central axis A. Also disposed within the interior is a reactive composition, such as the reactive composition 160 described above and throughout the specification. In an exemplary embodiment, reactive composition 160 comprises a rear reactive composition **160*a* configured to partially or entirely surround a portion or all of a surface (e.g. exterior) of penetrator 130. Additionally or alternatively, reactive composition 160 includes a front reactive composition 160***b* disposed within front tip 110. In an exemplary embodiment, front reactive composition 160*b* is configured to provide marking capabilities to projectile 100, such that upon impact with the target, at least front reactive composition 160*b* provides a visible indicator/locator of projectile impact (e.g. easily visible flash for confirmation of target impact). The marking capabilities of projectile 100 is illustrated, for example, in FIG. 12.

Figure 13:
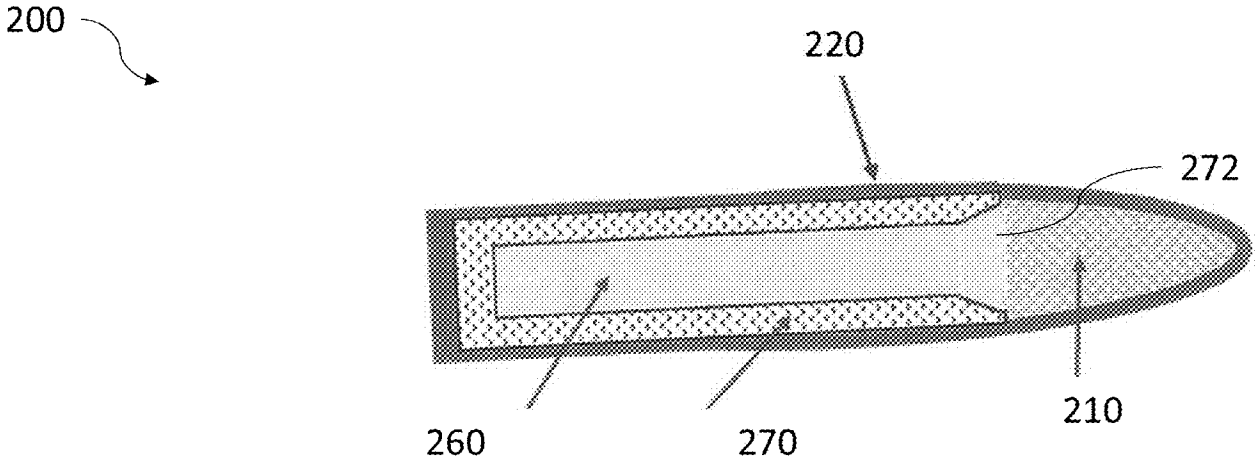
FIG. 13 depicts an exemplary armor-piercing projectile in accordance with an embodiment of the invention, showing metallic tube including hardened steel loaded with a reactive composition (and optionally a marking composition) and a nose comprising steel, brass, or aluminum.
Figure 14A:
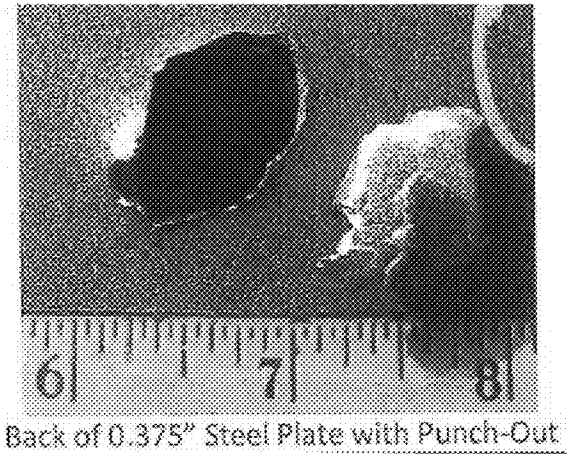
FIGS. 14A-14B depict results of an exemplary penetration test (measurable by a "punch out") of the projectile of FIG. 13, and the "punch out" acts as a new projectile further enhancing lethality.
Figure 14A:
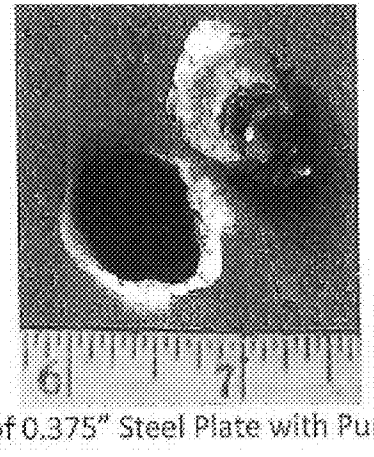
Figure 14A:
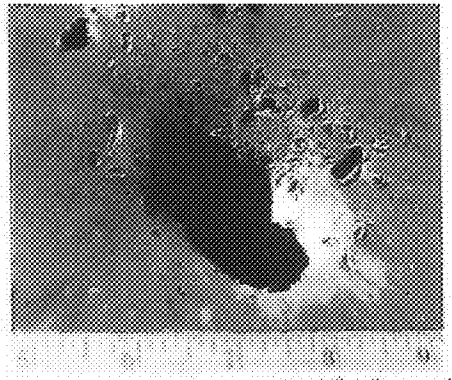
Figure 14A:
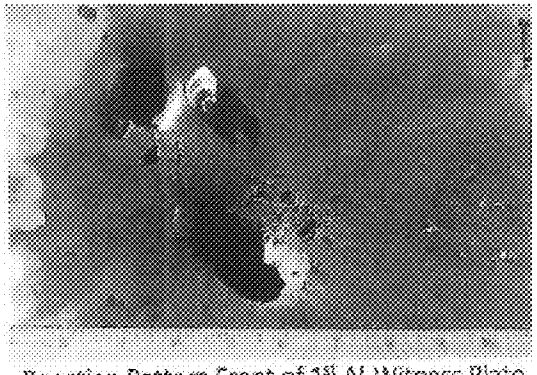
Figure 14B:
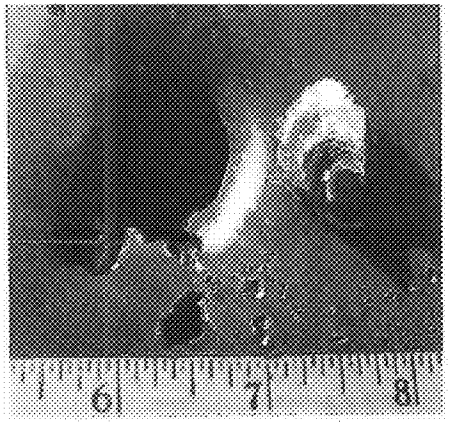
Figure 14B:
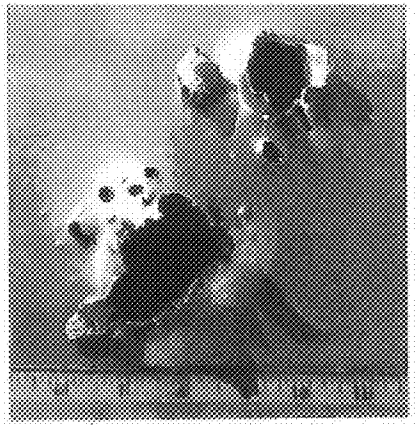
Figure 14B:
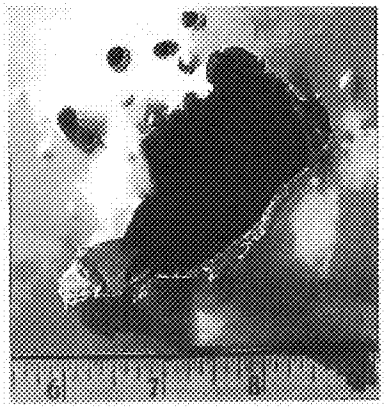
Figure 14B:
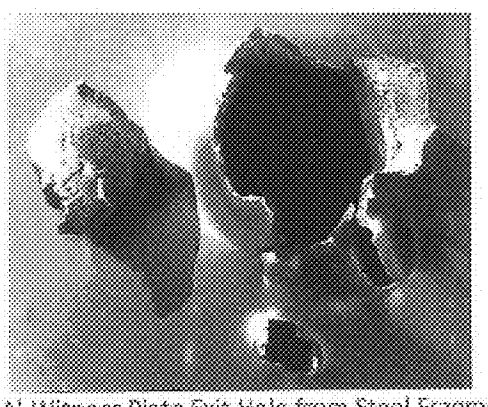

Another exemplary embodiment of projectile 100 is projectile 200, as shown in FIG. 13, which illustrates a cross-section of projectile 200. Projectile 200 may be similar to projectile 100 in certain respects; for example, projectile 200 comprises a tip 210 (the details of which are generally similar to that of tip 110) and an outer jacket 220 (the details of which are generally similar to that of outer jacket 120). Optionally, projectile 200 does not include a tip 210 and instead the outer jacket 220 may form a rounded shape. However, projectile 200 differs from projectile 100 in some respects. For example, the reactive composition 260 (the details of which are generally similar to that of reactive composition 160) is contained within a metal tube or cup 270 configured to travel toward, within, and/or behind a surface of the target. The metal tube or cup 270 may be formed out of conventional metals, alloys, and in preferred embodiments, of hardened steel. Tube or cup 270 may be formed such that the opening 272 is angled to increase penetration effectiveness as well as the diameter of the affected area on the target. Replacement of the penetrating (pin) 130 in the projectile with metal tube or cup 270 containing the maximum amount of reactive composition 260, permits the projectile 200 to penetrate or cut the target (e.g. steel target) in a circular manner, thereby creating an affected area having a larger diameter than that caused by conventional metal-pin penetrators. In particular, the metal cup or tube 270 cuts the target (e.g. steel or armor plate) for a depth of at least 0.5 inches, which produces a slog (with an equal diameter as the hole) in the target, which then acts as another projectile inside the target, thereby providing increased lethality (see for example, the results illustrated in FIGS. 14A-14B regarding use of projectile 200, which did not include a pin (core) and contained reactive composition 260 comprising the following ingredients: MgAl (50/50)—17.68%, CuO—82.32%).

Figure 16A:
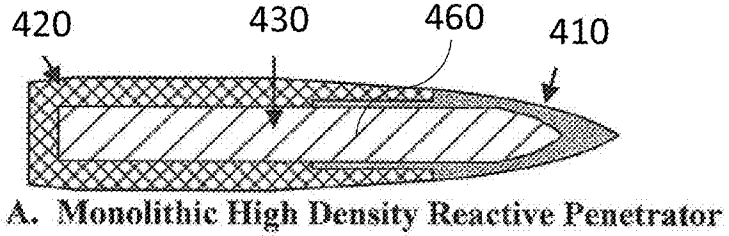
FIGS. 16A-16C depict embodiments of exemplary armor-piercing reactive projectiles.

Another exemplary embodiment of projectile 100 is projectile 400, as shown in FIG. 16A, which illustrates a cross-section of projectile 400. Projectile 400 may be similar to projectiles 100, 200 in certain respects; for example, projectile 400 comprises a tip 410 (the details of which are generally similar to that of tip 110, 210), an outer jacket 420 (the details of which are generally similar to that of outer jacket 120, 220), and an armor-piercing penetrator or penetrating pin 430 (the details of which are generally similar to that of pin 130). Also disposed within the interior is a reactive composition 460 (the details of which are generally similar to that of one or more of reactive composition 160, 260, 360), as described above and throughout the specification.

Figure 16B:
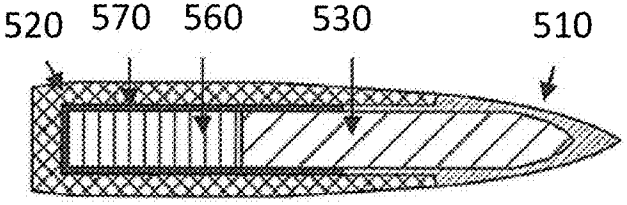

Another exemplary embodiment of projectile 100 is projectile 500, as shown in FIG. 16B, which illustrates a cross-section of projectile 500. Projectile 500 may be similar to projectiles 100, 200, 400 in certain respects; for example, projectile 500 comprises a tip 510 (the details of which are generally similar to that of tip 110, 210, 410), an outer jacket 520 (the details of which are generally similar to that of outer jacket 120, 220, 420), and an armor-piercing penetrator or penetrating pin 530 (the details of which are generally similar to that of pin 130, 430). Also disposed within the interior is a reactive composition 560 (the details of which are generally similar to that of one or more of reactive composition 160, 260, 360, 460), as described above and throughout the specification. In an exemplary embodiment, the reactive composition 560 (the details of which are generally similar to that of reactive composition 160, 360) is contained within a metal tube or cup 570 (the details of which are generally similar to that of tube or cup 270.

Figure 16C:
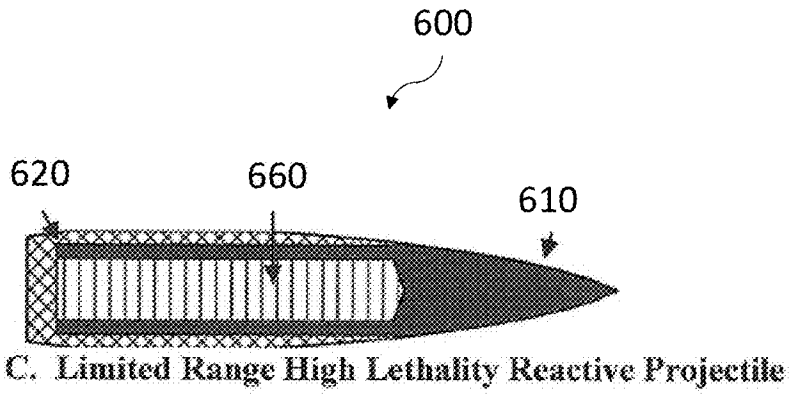

Another exemplary embodiment of projectile 100 is projectile 600, as shown in FIG. 16C, which illustrates a cross-section of projectile 600. Projectile 600 may be similar to projectiles 100, 200, 400, 500 in certain respects; for example, projectile 600 comprises an outer jacket 620 (the details of which are generally similar to that of outer jacket 120, 220, 420, 520) and a reactive composition 660 (the details of which are generally similar to that of one or more of reactive composition 160, 260, 360, 460, 560), as described above and throughout the specification. However, projectile 600 differs from other embodiments of the projectile in some respects. For example, projectile 600 comprises a tip 610. In an exemplary embodiment, the tip 610 comprises hardened steel and defines a rear cavity configured to receive or contain at least reactive composition 660.

Figure 15:
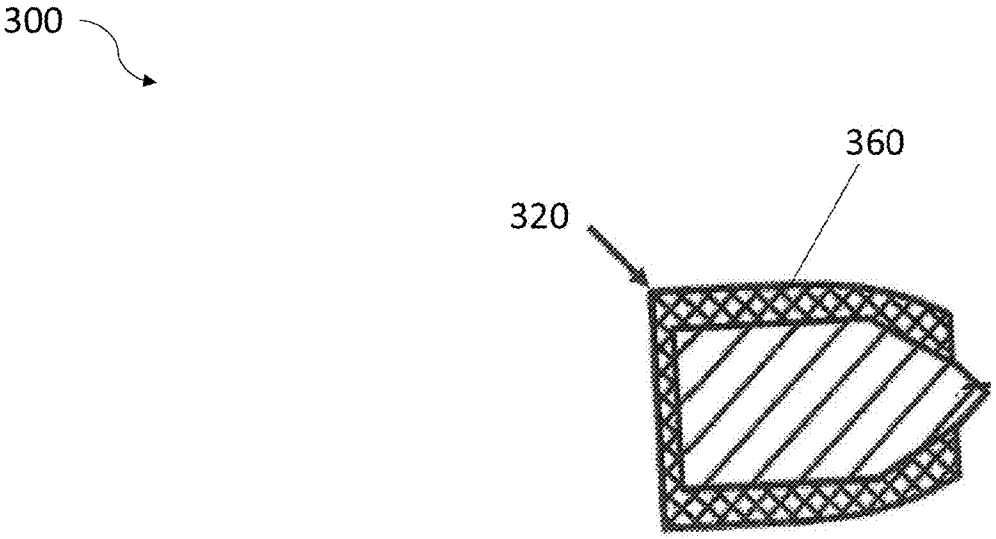
FIG. 15 depicts an exemplary projectile in accordance with an embodiment of the invention.

In still another exemplary embodiment, the reactive composition is contained within the projective as pellets (as prepared by pressing or extruding). Alternatively, the reactive composition is configured as rings of compressed material (e.g. a collar) around the penetrator (e.g. tungsten carbide penetrator). Still alternatively, the reactive composition is inserted behind the nose of the projectile and fills a cavity created by absence of the penetrating pin. Optionally, the reactive composition is inserted behind the nose of the projectile and fills in the remaining space of the cavity with the penetrating pin positioned therein. Optionally, as shown in FIG. 15, which illustrates a projectile 300 (the details of which are similar in certain respects to that of projectile 100 and/or projectile 200) for use with a hand gun (e.g. hand gun with reactive projectile 300 for defeating doors). The details of reactive composition 360 is generally similar to that of reactive composition 160, except that reactive composition 360 is of relatively higher density (approximately 7-10 g/cm$^3$, or 8-9 g/cm$^3$) and comprises mostly intermetallic compositions. Additionally or optionally, the projectile includes a reactive plugin adapted for marking the point of impact in/on the target. The reactive plug is positionable near the nose of the projectile, so as to produce a high-intensity fireball, which can be utilized for marking the point of impact in/on the target. In an exemplary embodiment, the reactive plug contains color producing materials, such as color producing compounds, including salts of B, Ba, Cu, Ca, Sr, Li, K, and Na as non-limiting 25 examples.

In an exemplary embodiment, the reactive composition is contained in a metallic tube which surrounds a penetrating pin. The penetrating pin comprises, for example, tungsten steel or tungsten carbide (WC). The reactive composition may also be positioned behind the nose and in the rear of the projectile.

A reactive penetrator or pin containing a dense reactive composition is disclosed. The reactive penetrator containing the reactive composition can penetrate targets, such as those comprising steel, as well as generate incendiary products, high temperature, and pressure inside targets, thereby increasing lethality of the penetrator or pin upon impact with targets. In an exemplary embodiment, the reactive penetrator includes intermetallic compositions having a density range between 7 g/cm$^3$ and 10 g/cm$^3$, thereby replacing (or eliminating the use of) the nose and pin in the conventional rounds. Accordingly, this reactive penetrator containing the reactive composition may simplify the design, reduce cost, and eliminate or reduce environmental toxicity.

In another exemplary embodiment, a reactive penetrator or pin contains a reactive composition that comprises reactive materials having a high density (e.g. having a density of 8 g/cm$^3$ to 10 g/cm$^3$), surrounded by reactive materials having a relatively lower density. The combination of high density and lower density reactive materials permits penetration by the pin, followed by generation of hot hard particles and hot gases inside (or behind a surface of) the target, thereby raising the temperature, pressure, and/or damage (lethality). In sum, this combination allows for penetration of the target, as well as increased incendiary effect or lethality (e.g. temperature, heat, energy, and/or pressure) after penetration of the target.

Figure 17:
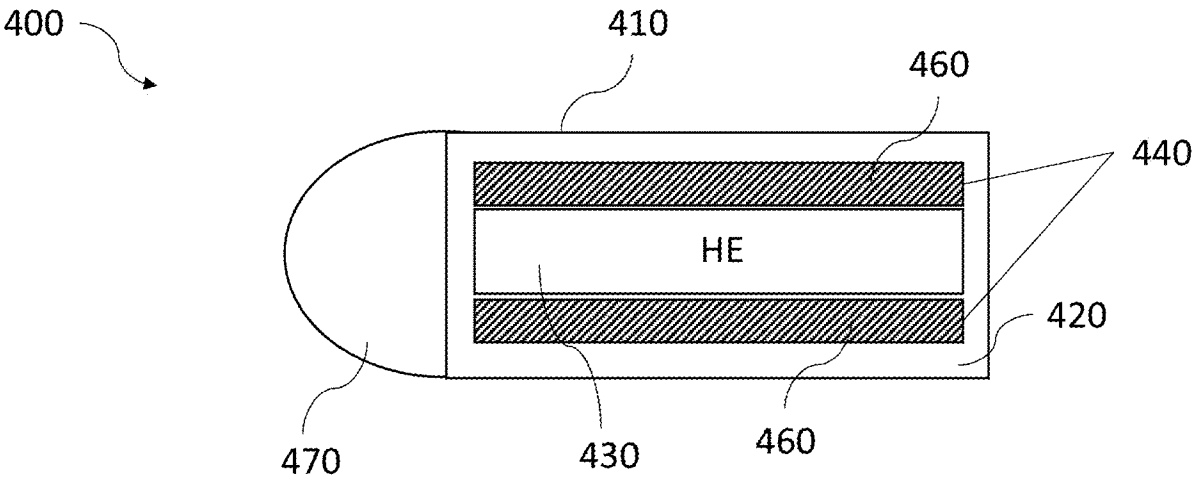
FIG. 17 depicts an exemplary projectile or munition in accordance with an embodiment of the invention.

Other applications for the use of the reactive composition will be known to one skilled in the art from the description herein. In a non-limiting example, the reactive composition may be used in reactive cases for warheads/munitions. In another exemplary embodiment, as shown in FIG. 17, an exemplary projectile, such as projectile 400, includes a housing 410 having a cavity 420; high explosives (HE) 430 disposed in the cavity 420; and a metallic foam 440 impregnated with a reactive composition 460 (which is similar in detail to previous embodiments, such as reactive composition 160, 260, 360). Foam 440 comprises Al, Zr, Ti, or any reactive metal. In this way, the reactive composition may be encapsulated in HE munitions as a liner. The liner has a metallic porous foam, such as foam 440, impregnated with the reactive composition 460, thereby providing thermobaric effects such as enhanced blast, larger and longer lasting and further reaching fireballs. In this way, metal foams including the reactive composition achieve increased lethality because of the addition of the reactive composition (compared to a projectile having high explosives alone). Optionally, projectile 400 includes a tip or nose 470 (the details of which are generally similar to that of tip 110, 210) coupled to the housing. Upon impact with a target, the projectile 400 is configured to provide a damage property including one or more of deeper penetration into the target, enhanced blast from shrapnel, and generation of larger fireballs relative to a projectile having only high explosives.

EXAMPLES

Example 1: Reactive Pistol Projectiles

The inventors assessed the improvements in lethality made possible by the inventive reactive composition. A prototype projectile including the inventive reactive composition was subjected to various testing as detailed herein. For the construction of the reactive pistol projectile prototype, the projectile comprised a soft metallic jacket with the reactive composition contained therein. The reactive composition for the pistol projectile comprised a high-density material produced under controlled pressure and heat temperature below exothermic reaction. Further, the reactive composition had a density of 12.9 g/cm$^3$ comprised the following ingredients: (W (powder)—52.72%, Ni—21.84%, Al—20%, Ti—5.44%). The projectile did not include a pin. Tests were performed for the use of the projectile and/or the reactive composition for the following applications: (i) Door Defeat; (ii) Marking or Incendiary Effect; and (iii) Penetration.

Door Defeat Test

Figure 2:
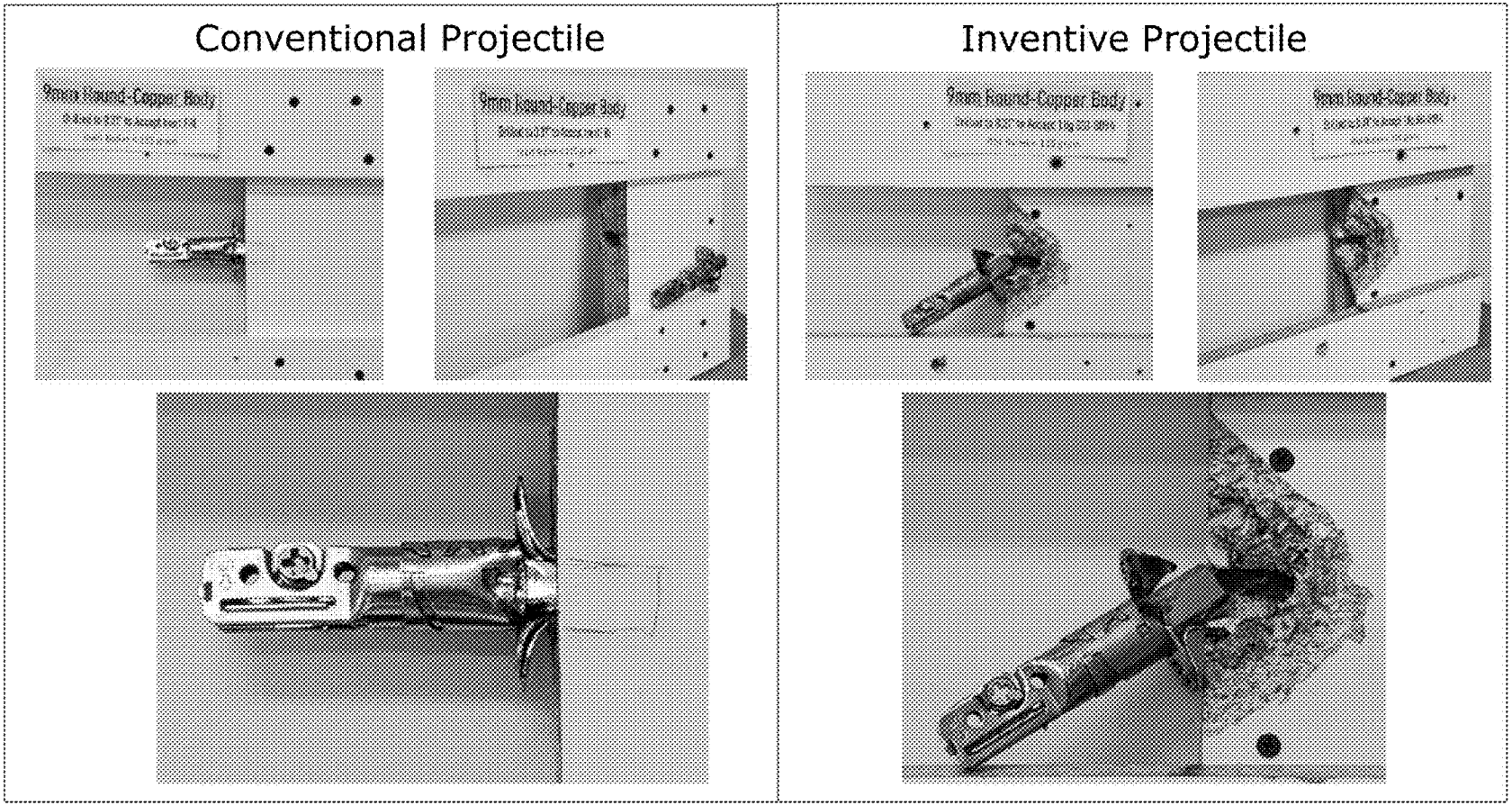

Referring to FIGS. 1-2, an exemplary door defeat test was performed, in order to assess lethality of the projectile upon impact with the target. In particular, a damage property or metric of the prototype projectile containing the reactive composition was assessed. As shown in FIG. 1, the circled portions of the door demonstrate a damage property, e.g. a perforation of at least a portion of the target door. In addition, as illustrated in FIG. 2, a qualitative assessment indicates that greater damage is visible on the door target of the inventive prototype projectile, relative to that of the conventional projectile (where much of the door is still left intact, including the lock which has not been disengaged form the door structure).

Marking or Incendiary Effect Test

Figure 3:
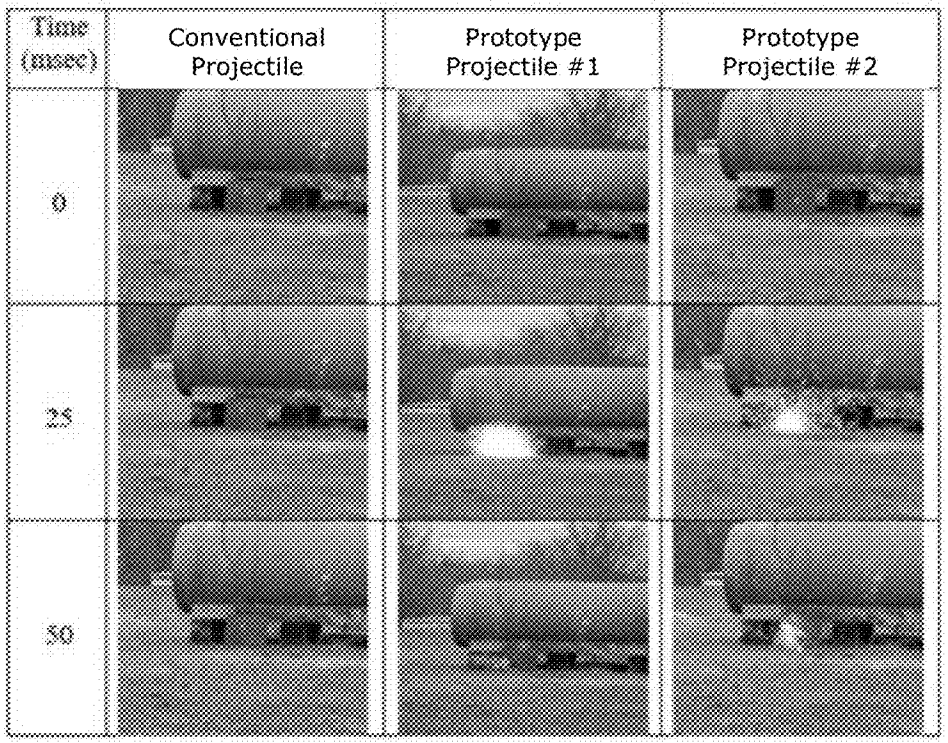
FIG. 3 depicts results of an exemplary marking or incendiary effect test.

Referring to FIG. 3, an exemplary marking or incendiary effect test was performed, in order to assess lethality of the projectile upon impact with the target and/or assess the marking or visible indicator/locator of projectile impact (e.g. easily visible flash for confirmation of target impact). Two prototype projectiles containing the reactive composition were prepared. For the construction of the prototype projectile #1, an exemplary embodiment of the reactive composition was loaded into a 9 mm handgun bullet, to be fired at or toward a commercially available AR500 Steel (abrasion resistant (AR) steel plate) target. For the construction of the prototype projectile #2, another and different exemplary embodiment of the reactive composition was loaded into another 9 mm handgun bullet, to be fired at or toward another commercially available AR500 Steel (abrasion resistant (AR) steel plate) target.

As illustrated in FIG. 3, no visible flash appeared with the use of conventional projectile without the reactive composition. Compared to the conventional projectile, prototype projectile #1 with a first embodiment of the reactive composition emitted a visible flash (see at 25 milliseconds). In particular, a bright orange flash was observed with minimal sparks. Compared to the conventional projectile and prototype projectile #1, prototype projectile #2 provided superior or relatively improved results. Specifically, prototype projectile #2 emitted more hot particles or sparks, albeit having smaller size flash (compared to prototype projectile #1). Nonetheless, prototype projectile #2 emitted sparks, which were dispersed 5 meters away from the target and remained active for more than 30 milliseconds.

Penetration Test

Figure 4:
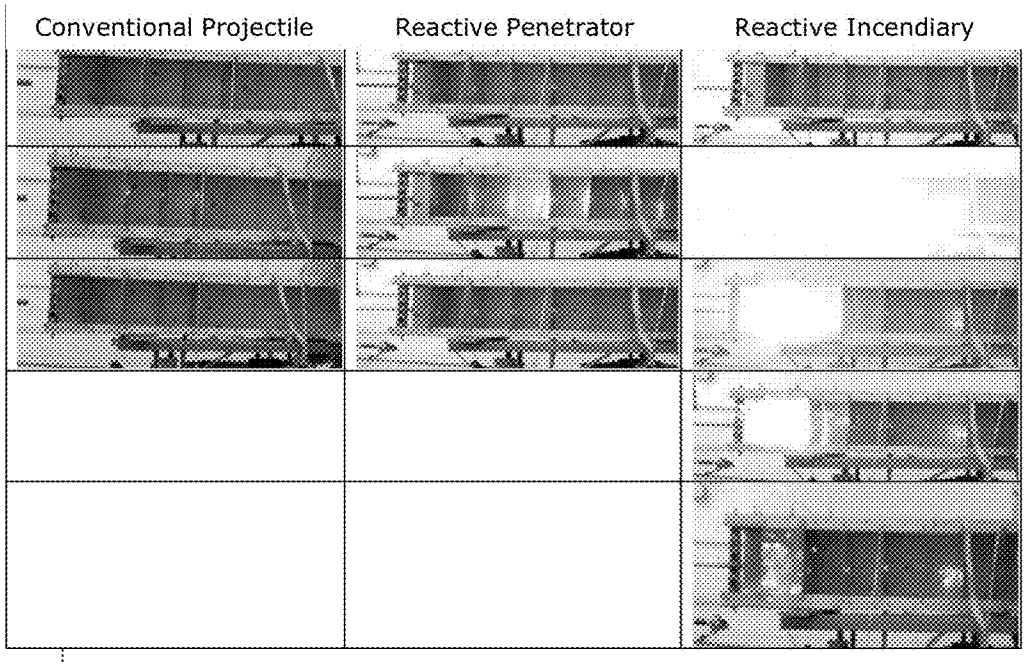
FIG. 4 depicts results of an exemplary penetration test.

Referring to FIG. 4, an exemplary penetration test was performed, in order to assess lethality of the projectile upon impact with the target. A handgun projectile (9 mm round) was shot through a mild steel (1 mm) witness plate array. The conventional projectile penetrated 5 plates with minimal damage. In contrast, the reactive penetrator projectile penetrated through all 8 plates and through the 1.5 inches wooden rear block. The reactive incendiary projectile penetrated 5 plates and caused significantly more damage, as illustrated by the incendiary effect (flashes and explosion, after penetration of first plate) 20) shown in FIG. 4.

Example 2: Damage Assessment

The inventors assessed the improvements in lethality made possible by the inventive reactive composition. A prototype projectile including the inventive reactive composition was subjected to various testing as detailed herein. As used herein and throughout the specification, the details of the prototype projectiles #1 to #4 are as follows:

TABLE 2

| Exemplary Projectiles #1-#4 | |
|---|---|
| Projectile | Reactive Composition |
| Projectile #1 | Ti-25.45%, KP - 59.39%, PTFE - 13.57%, PCTFE - 1.6% |
| Projectile #2 | Ti - 22%, B - 20%, KP - 29%, W - 4%, PVDF - 5% |
| Projectile #3 | Ti - 26.63%, CuO - 17.70%, Potassium Periodate ($KIO_4$) - 51.18%, PVDF (Polyvylidene Fluoride) - 4.8% |
| Projectile #4 | Ti - 32.96%, KP - 41.94%, 5ATZ (Aminotetrazole) - 15%, W(powder) - 5%, MG-Stearate - 0.6%, PVDF - 4.5% |

Damage on Aluminum Semi-Infinite Targets (AIS-IT) Test

For the construction of these prototypes, Projectiles #1 to #4 have WC (tungsten carbide) pins. The prototype projectile #1 comprised a 0.50 CAL projectile with an exemplary embodiment of the reactive composition contained therein and the prototype projectile #2 comprised a 0.50 CAL projectile with another exemplary embodiment of the reactive contained therein. The conventional projectile was a Raufoss Mk211 projectile. The target was a 4 inch diameter×3 inch tall aluminum plate.

Figure 5:
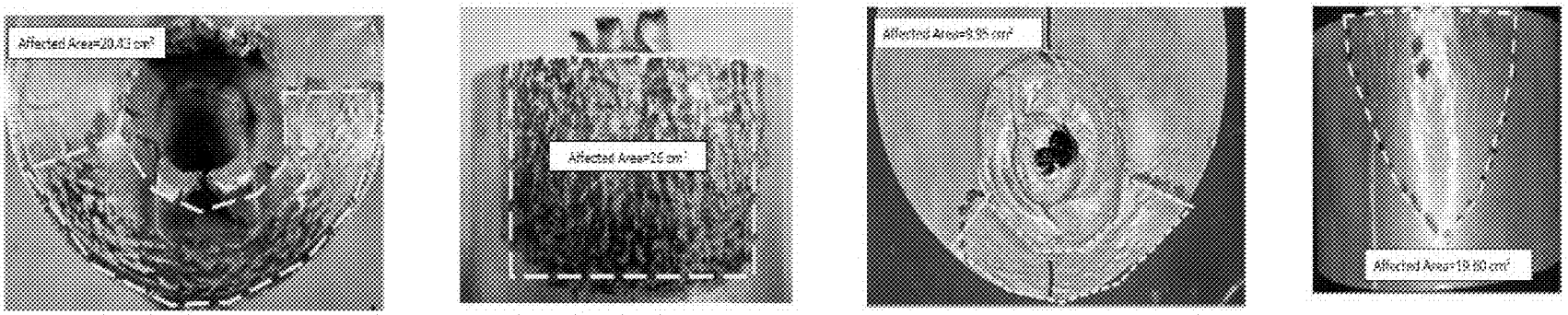
FIG. 5 depict results of an exemplary damage test.

Referring to FIG. 5, an exemplary damage test was performed, in order to assess lethality of the projectile upon impact with the target. In particular, a damage property or metric of the prototype projectile containing the reactive composition was assessed. As shown in FIG. 5, both prototype projectile #1 and prototype projectile #2, when compared to the conventional projectile, show greater cavity volume and cavity depth as a result of impact of the projectile with the target. Further, as shown in the images depicted in FIG. 5, the affected area on the target after impact with the prototype projectile #1 were 26 $cm^2$ and 20.43 $cm^2$ (total of 46.43 $cm^2$), which is greater than the affected areas with conventional projectile (9.95 $cm^{2+19.60}$ $cm^{2=29.55}$ $cm^2$).

Figure 7:
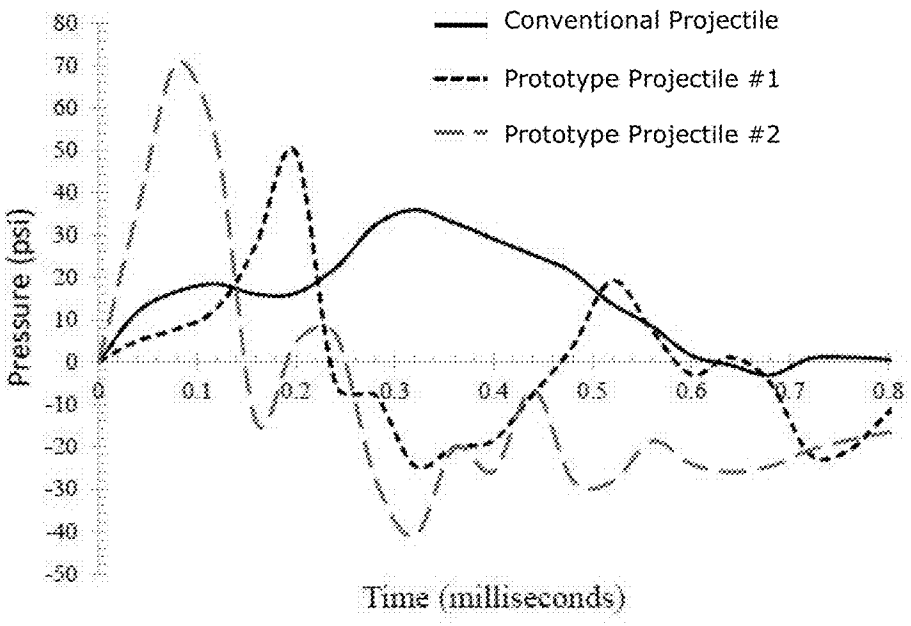
FIG. 7 depicts results of an exemplary incendiary effect after penetration of 0.5 inches of hardened steel.
Figure 7:
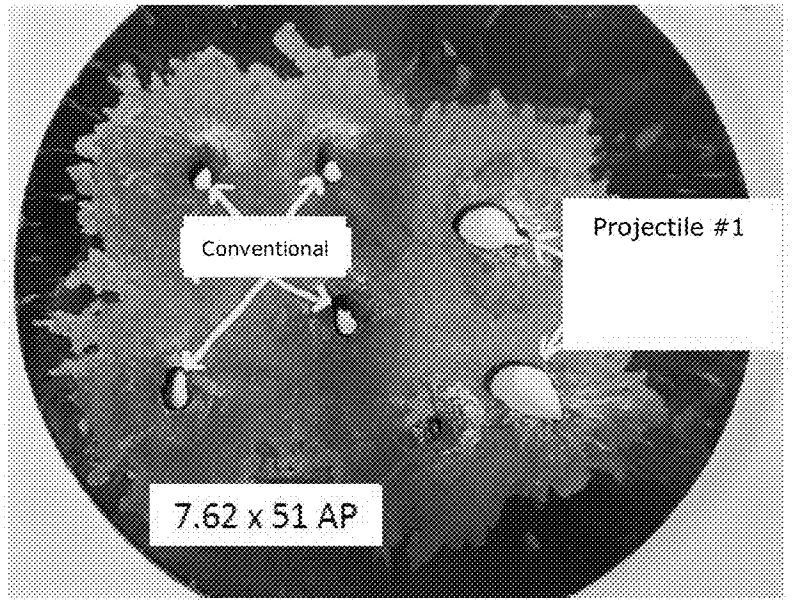

In another exemplary damage test, as shown in Table 3 below, the prototype projectiles produced larger cross-section areas of damage (in $cm^2$), compared to the conventional projectile, on 3-inches diameter hard steel (AR-500) target, as also shown in FIG. 7 (discussed below).

TABLE 3

| Damage Test | | |
|---|---|---|
| Projectile | Target = Steel Plate ($cm^2$) | Target = Al Plate ($cm^2$) |
| Conventional Projectile | 0.8 | 10.4 |
| Prototype Projectile #1 | 3.7 | 39 |
| Prototype Projectile #3 | 5.6 | 52.3 |
| Prototype Projectile #4 | 4.44 | 40.8 |

Total Overpressure Inside Closed Vessel Test

Figure 6:
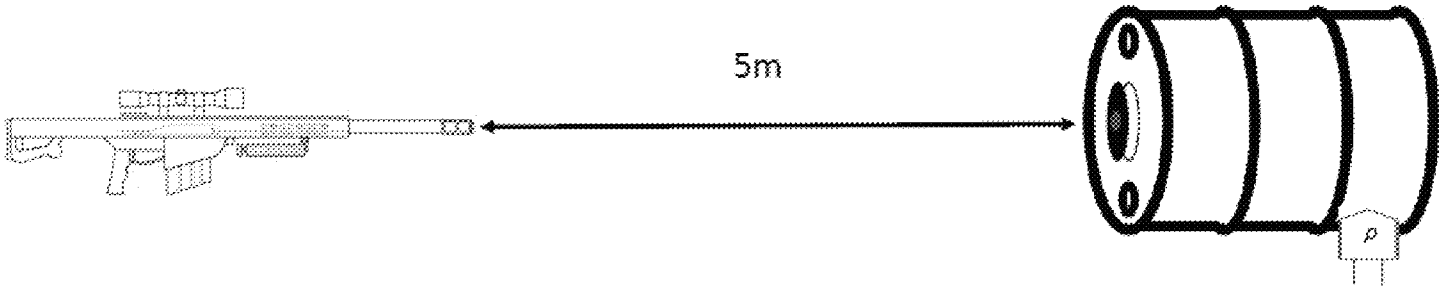
FIG. 6 depicts a schematic of an exemplary overpressure test.
Figure 8:
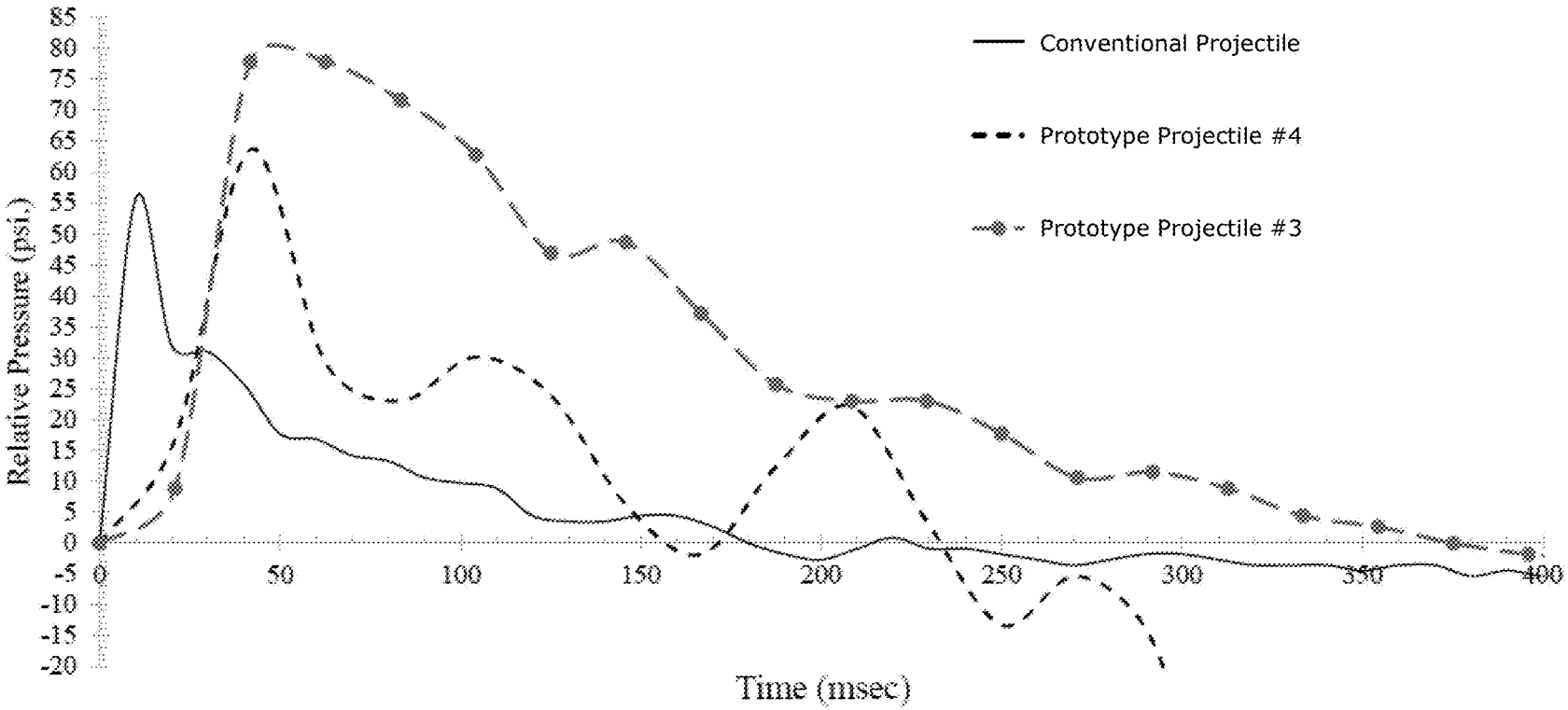
FIG. 8 depicts results of another exemplary overpressure test after penetration of hardened steel.

In the same test series, the target was a ⅜-inch AR500 Steel Plate affixed to a 55 gallon drum. An exemplary total overpressure test was performed, in order to assess lethality of the projectile upon impact with the target. Specifically, as shown in the schematic of FIG. 6, overpressure inside of the closed vessel (drum) was measured by calibrated pressure transducers and duration of incendiary effect was also measured. Turning now to the graphs depicted in FIGS. 7 and 8, the measured total overpressures for prototype projectiles #1 to #4 were generally greater than the conventional projectile counterparts, as also shown in detail in FIG. 8 (the prototype projectiles with the inventive reactive compositions contained therein generated a higher peak overpressure (by approximately 39%-98%) and had a longer incendiary event/effect duration (by approximately 180%-200%)).

Incendiary Effect Test

Figure 9:
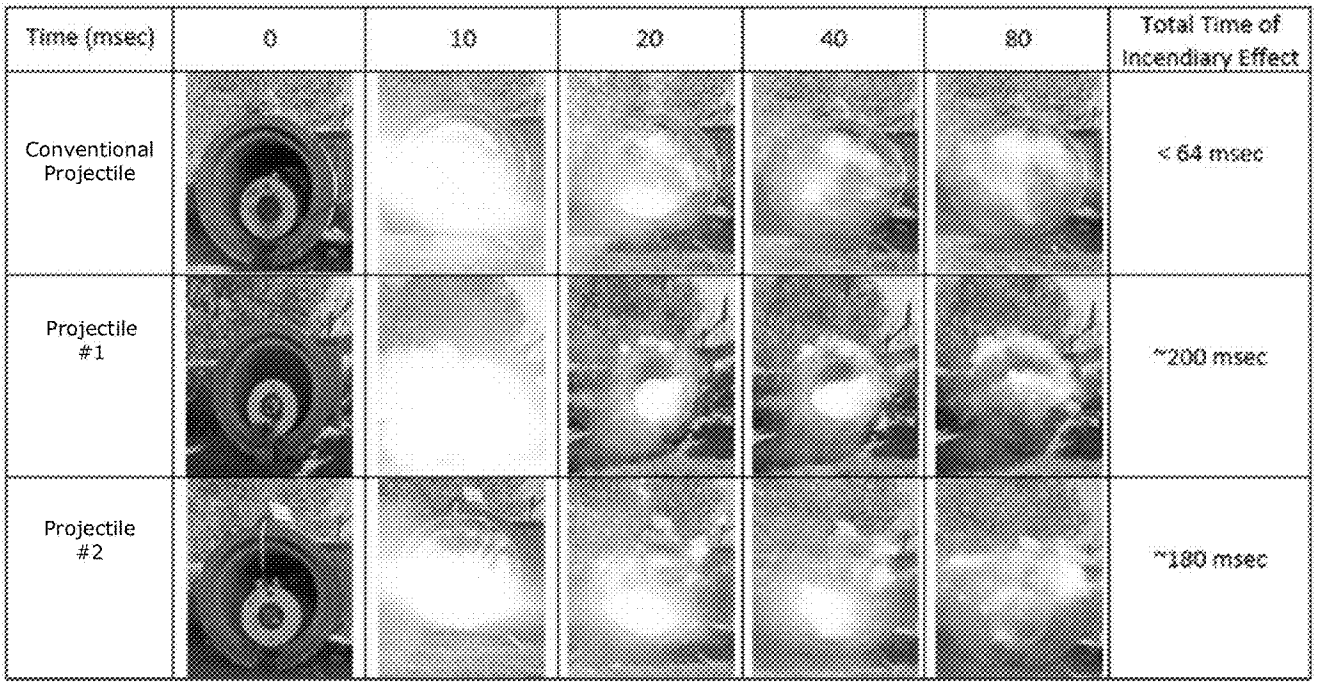
FIG. 9 depicts results of an exemplary penetration test of 0.5 inches of hardened steel.

An exemplary incendiary effect test was performed, in order to assess lethality of the projectile upon impact with the target. Specifically, as shown in the schematic of FIG. 9, duration of incendiary effect was measured. The duration for both prototype projectile #1 and prototype projectile #2 was generally greater (e.g. 4× greater) than the conventional projectile counterpart.

Behind the Target Lethality Test

Figure 10A:
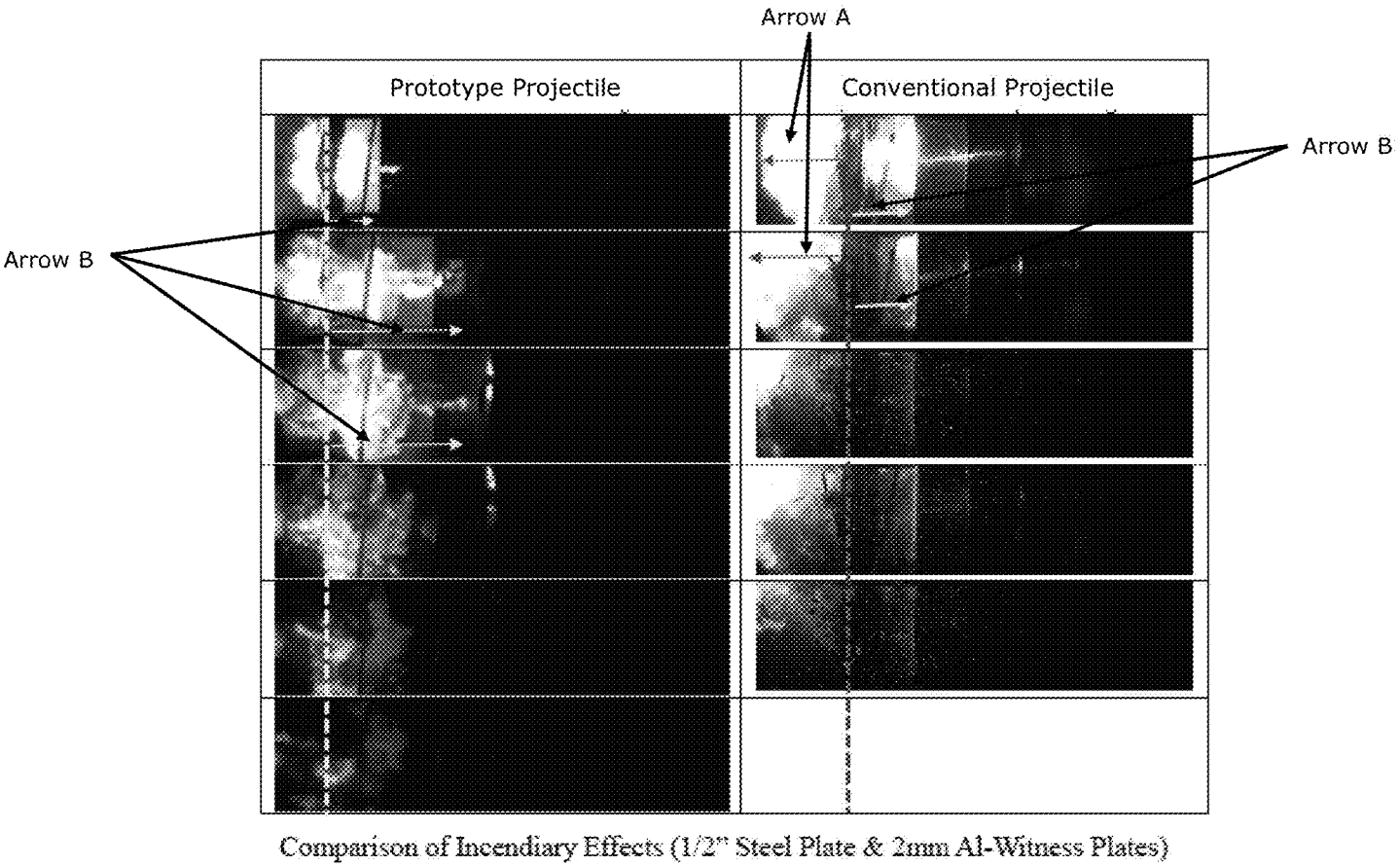
FIGS. 10A-10B depict results of another exemplary incendiary effect test.
Figure 10B:
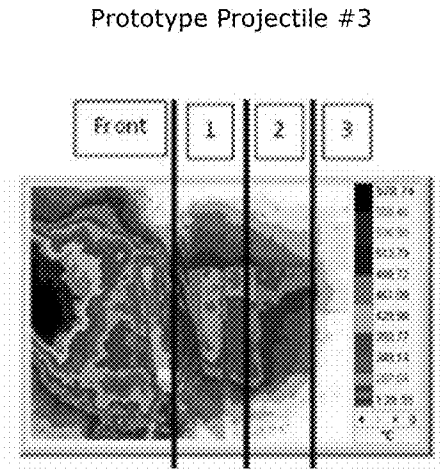
Figure 10B:
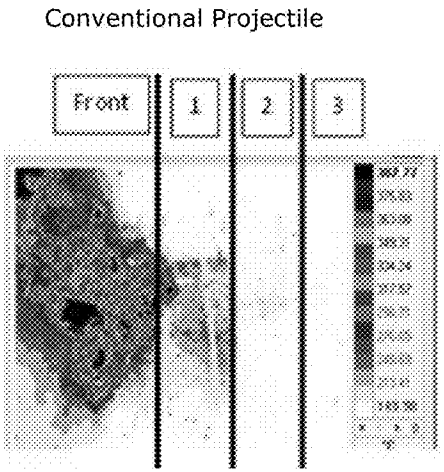

Referring to FIGS. 10A-10B, an exemplary test was performed, in order to assess lethality of the projectile based on energy (thermal and pressure) and after penetration of the target (e.g. behind or within the target). The target is a ½ inch (12.7 mm) Heat Treated Steel Plate, with 8 witness plates (2 mm Al 3003) spaced 6 inches apart. Pressure transducers were affixed to the first 3 chambers behind the steel plate. Prototype projectile comprised a 0.50 CAL projectile with another exemplary embodiment of the reactive composition contained therein.

As shown in FIG. 10A, with the conventional projectile (right column), the incendiary effect moves away (to the left of the dashed line, as indicated by the arrows A) from the target, because the conventional projectile contains high explosives (HE), which reacts extremely fast and primarily in front of the target. The conventional projectile principally generated a surface explosion, which produced minimal damage to the witness plates. In contrast, with the use of the inventive projectile (left column), the incendiary effect moves toward the target (to the right of the dashed line, as indicated by the arrows B), thereby causing more damage and overpressure (i.e. increased lethality), which carried over the incendiary effects through the witness plates. These results are further confirmed by infrared images capturing the thermal or incendiary effect, as depicted in FIG. 10B. Thus, the incendiary effect is able to cause more damage further behind or within the target, thereby increasing efficiency and lethality.

In conclusion, the various experiments described herein indicate improvements in one or more of duration of incendiary effect, size of target perforations, overpressure behind the surface of the target, and volume/depth of target damage. Specifically, the reactive composition provides improvements in at least one of a maximum overpressure and the incendiary effect, with the improvements being significantly higher than the baseline or conventional projectiles, thereby allowing various projectile designs to breach, inter alia, hard steel armor plates and/or cause additional or enhanced lethality behind the armor (e.g. inside targets of interests, including but not limited to, armored vehicles and aircraft).

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A projectile comprising:

a housing having a cavity;

a vessel disposed within the housing, a reactive composition disposed within the vessel, the reactive composition comprising:

at least one fuel comprising a titanium-boron composite;

at least one oxidizer; and at least one metal hydride;

wherein when the projectile penetrates through a surface of a target having a volume of 0.2 $m^3$, the reactive composition is configured to cause, behind the surface of the target, at least one of an overpressure of greater than 60 pounds per square inch (psi) or an incendiary effect duration of greater than 70 milliseconds.

2. The projectile of claim 1, further comprising one or more high-density metals, such that the reactive composition has a density in a range between 8 $g/cm^3$ and 10 $g/cm^3$.

3. The projectile of claim 1, wherein the at least one oxidizer comprises bismuth trioxide, potassium nitrate, copper oxide, or potassium perchlorate.

4. The projectile of claim 1, wherein the overpressure is greater than 80 psi.

5. The projectile of claim 1, wherein upon impact with the target, the reactive composition is configured to provide a damage property related to at least a portion of the target, the damage property comprising a penetration of the target.

6. The projectile of claim 1, wherein the vessel is a metallic tube.

7. The projectile of claim 6, wherein the metallic tube comprises hard steel.

8. The projectile of claim 7, wherein upon impact with the target, the reactive composition is configured to provide a damage property comprising producing a punch out configured to act as an additional projectile inside the target, thereby enhancing projectile lethality.

9. The projectile of claim 6, wherein a portion of a penetrating surface of the projectile extends into the metallic tube.

10. The projectile of claim 1, wherein the reactive composition partially or entirely fills an internal volume of the housing.

11. The projectile of claim 1, wherein the reactive composition is in the form of one or more of a granule, a powder, a pellet shape, and a tube shape.

12. The projectile of claim 1, wherein the at least one fuel is partially coated or entirely encapsulated with a grease or other polymeric material.

13. The projectile of claim 1, wherein the at least one metal hydride comprises one or more of titanium hydride, magnesium hydride, and aluminum hydride.

* * * * *